US006808386B2

(12) United States Patent
Huang

(10) Patent No.: US 6,808,386 B2
(45) Date of Patent: Oct. 26, 2004

(54) GAS LIGHTER WITH A LOCKING DEVICE

(75) Inventor: Xinhua Huang, Ningbo (CN)

(73) Assignee: Ningbo Xinbai Electronics Manufacture Co. Ltd. (CN)

( * ) Notice: Subject to any disclaimer, the term of this patent is extended or adjusted under 35 U.S.C. 154(b) by 0 days.

(21) Appl. No.: 10/353,258

(22) Filed: Jan. 27, 2003

(65) Prior Publication Data

US 2003/0194670 A1 Oct. 16, 2003

(30) Foreign Application Priority Data

Apr. 10, 2002 (CN) ..... 02216811 U

(51) Int. Cl.[7] ..... F23D 11/36
(52) U.S. Cl. ..... 431/153; 431/255
(58) Field of Search ..... 431/153, 255, 431/344, 276, 277

(56) References Cited

U.S. PATENT DOCUMENTS

| | | | | |
|---|---|---|---|---|
| 5,145,358 A | | 9/1992 | Shike et al. | 431/153 |
| 5,829,963 A | * | 11/1998 | Ichikawa | 431/255 |
| 5,839,892 A | | 11/1998 | Hwang | 431/153 |
| 6,126,437 A | | 10/2000 | Lixiang et al. | 431/153 |
| 6,200,130 B1 | | 3/2001 | Man | 431/153 |
| 6,206,689 B1 | * | 3/2001 | Doucet | 431/153 |
| 6,217,313 B1 | | 4/2001 | Luo | 431/153 |
| 6,287,109 B1 | | 9/2001 | Hirota | 431/153 |
| 6,386,860 B1 | | 5/2002 | Adams et al. | 431/153 |
| 6,533,575 B2 | * | 3/2003 | Man | 431/255 |

* cited by examiner

*Primary Examiner*—James C. Yeung
(74) *Attorney, Agent, or Firm*—Ostrolenk, Faber, Gerb & Soffen, LLP

(57) ABSTRACT

A gas lighter with a locking device of q-shape for reliably preventing ignition of the lighter when the actuator is in its locked position, and allowing ignition of the lighter when the locking device is moved from the locked position to a second unlocked position. The piezoelectric device has a step, and an end portion of the locking device contacts with the step in its locked position. When the users operate the locking device, the end portion of the locking device can be disengaged from the step. When the locking device is in its unlocked position, the actuator of the gas lighter can be pressed down to ignite the gas lighter. When the external force is missing, the locking device returns to a normal locking position by the spring force of the piezoelectric device. According to the present invention, the safety of the gas lighter is improved and the potential safety hazard due to an unintentional operation is eliminated.

16 Claims, 3 Drawing Sheets

GAS LIGHTER WITH A LOCKING DEVICE

1. FIELD OF THE INVENTION

The present invention relates to a gas lighter, and more particularly to a gas lighter with a locking device to prevent the gas lighter from being unintentionally ignited.

2. DESCRIPTION OF RELATED ART

A gas lighter commonly used at present is an electric igniter using combustible gas, such as butane and natural gas, as a fuel. It can generate a flame usually by means of pressing the operative actuator directly by the fingers and permitting the piezoelectric block in a piezoelectric device to spark so as to ignite the combustible gas. Without a locking mechanism in the lighter, the operation of the actuator is not restricted, so that an unintentional operation of the actuator, such as an error operation, an operation by the infant, or some unintentional collision by a hard thing acting on the actuator, can easily ignite the combustible gas in the lighter, which will hurt the infant or damage the public safety. In addition, when an external force unintentionally acts on the actuator, the outlet valve will be opened, and then the combustible gas is leaked off, so that there is a potential risk due to the leaking of the combustible gas. However, in everyday life, such igniter has been widely used in many cases where an ignition is required. As described above, most of the commercially available gas lighters are dangerous if they are operated carelessly, particularly by young children. The inadvertent ignition of such gas lighters has resulted in fires causing property damage and injury to people. Therefore, there is a need for a lighter with a locking device that prevents inadvertent ignition of the gas lighters, and in particular makes it difficult for the children to operate the lighters.

Gas lighters sold in commerce are now required by federal law to have locking device to prevent young children from being able to ignite the lighters. It is desirable to increase the difficulty of operating the lighters so as to limit the young children under five years of age to operate such piezoelectric lighters. This remains, however, a need in the art for other mechanism, which increase the difficulty of unintentional operation or operation by unintended users, and at the same time are user-friendly for intentional operation by intended users.

A lighter of the above-mentioned type is shown in U.S. Pat. No. 5,145,358, wherein the locking device is a safety member cooperating with a blocking ridge for the piezoelectric device when the locking device is in its locked position in which position said device cannot generate a flame. However, after each ignition, the locking device is restored to its locked position by means of the spring force of the additional resilient element provided in the lighter, which results in the complexity of the assembling operation and the increase of the manufacturing cost.

In fact, in the generally available gas lighters with a locking device, the locking device can be reset automatically by the elastic force of a spring device after each operation of the ignition mechanism of the gas lighters. Therefore, such lighters also involve the additional elastic elements provided therein, which also results in the complexity of the assembling operation and the increase of the manufacturing cost.

There is another kind of lighter with a locking device in the prior art wherein the locking device is restored to its locked position after each ignition by the resilient force generated by deforming a resilient element such as a plastic element. In such lighter, the resilient force generated by means of deforming the plastic element itself will be reduced due to the frequency of using the lighter. Finally, the locking device will fail to work efficiently because the plastic element can not be resiliently restored to its original form.

SUMMARY OF THE INVENTION

It is a purpose of the present invention to provide a gas lighter with a locking device, which reliably prevents ignition of the lighters when the locking device is in its locking position.

Therefore, the present invention proposes a gas lighter with a locking device of a novel design. A lighter with a locking device according to the present invention comprises: a housing for containing a fuel, a piezoelectric device and an outlet device in said housing, a spring in the piezoelectric device, wherein the piezoelectric device comprises a piezoelectric rod operatable to spark and an actuator co-operated therewith, the outlet device comprises an outlet valve and a lever operateably coupled to said outlet valve so as to open and close said outlet valve, said actuator being provided above said piezoelectric rod and said lever to open said outlet valve while sparking by said piezoelectric rod with sufficient voltage to cause a spark and ignite a vaporized fuel releasable from said housing through said outlet valve, said actuator having a top surface, characterizes in that said piezoelectric rod is provided with a case which forms a step for the piezoelectric rod, a locking device is pivotally coupled within the inner chamber of the actuator via a shaft, said locking device is of q-shaped, the upper end thereof is protruded out of the upper surface of the actuator through an opening in the actuator, the middle portion thereof abuts against a top cap of the piezoelectric rod, and the lower end thereof normally abuts against the step of the piezoelectric device by means of the resilient force of the spring provided in the piezoelectric device.

The gas lighter with a locking device according to the present invention can be used more convenient compared to the lighter described in the prior art because it only concerns the pivoting motion of the locking device about the actuator, but not the movement of the entire actuator.

Furthermore, the pivoting motion of the locking device according to the present invention is more difficult to achieve for an unintended user of the gas lighter compared to the simple translation motion used in the lighter of the prior art.

The locking device of the present invention has a lower portion which can cooperate with a step of the piezoelectric device in order to lock the actuator when it is subjected to a conventional force applied by any user to operate the gas lighter.

The locking device is of q-shaped. The top portion of the locking device is flattened and curved to prevent unintentional operation by a child, while permitting an adult to easily unlock the locking device so as to ignite the lighter.

According to the gas lighter with locking device of the present invention, the top end portion of the locking device is grooved and/or embossed to facilitate its use by a user. This groove and/or emboss has a general V-shaped cross section with an upward directed opening and which is slightly tilted to the longitudinal direction so that one of the sides of the V shape is aligned with this direction.

According to the gas lighter with a locking device of the present invention, the locking device is pivotally coupled within the actuator via a shaft. The shaft comprises an orifice passing therethrough to receive the axis of the locking device. The axis acts as a pivoting axis for the movement of the locking device in the position shown in FIG. 3. The pivoting axis is arranged perpendicularly to the longitudinal direction. Thus the locking device is fixed to the actuator via its axis.

The locking device is integrated with the actuator by a projection of the locking device and/or its axis. Under the action of a first force, a pivoting motion is made towards the top end of the device to which a second force is applied to displace said actuator from its locked position towards the unlocked position, wherein the locking device pivots about the actuator so as to change its position.

The side-middle portion of the locking device acts as a cam and contacts with the top cap of the piezoelectric rod. The case of the piezoelectric rod forms a step, and the end portion of the locking device contacts with the step in its locked position, wherein said lighter cannot generate a flame.

In order to move the locking device from the locked position to the unlocked position when the lighter is placed in vertical position, the user must move the locking device by the first horizontal force applied by the thumb, thus the end portion of the locking device can be disengaged from the step. The locking device is in its unlocked position, wherein said device can generate a flame, and at the end of the movement, the actuator of the gas lighter must be pressed to ignite the gas lighter by the second pressing down force applied in the adjacent region by the thumb so as to press down the actuator by changing the direction of the forces applied by the thumb without changing the position of the thumb. When the above-mentioned external force is missing, the locking device can be reset to a normal locking position wherein said device cannot generate a flame by the force of the piezoelectric rod.

5. DETAILED DESCRIPTION OF A PREFERRED EMBODIMENT OF THE INVENTION

Figure 1:
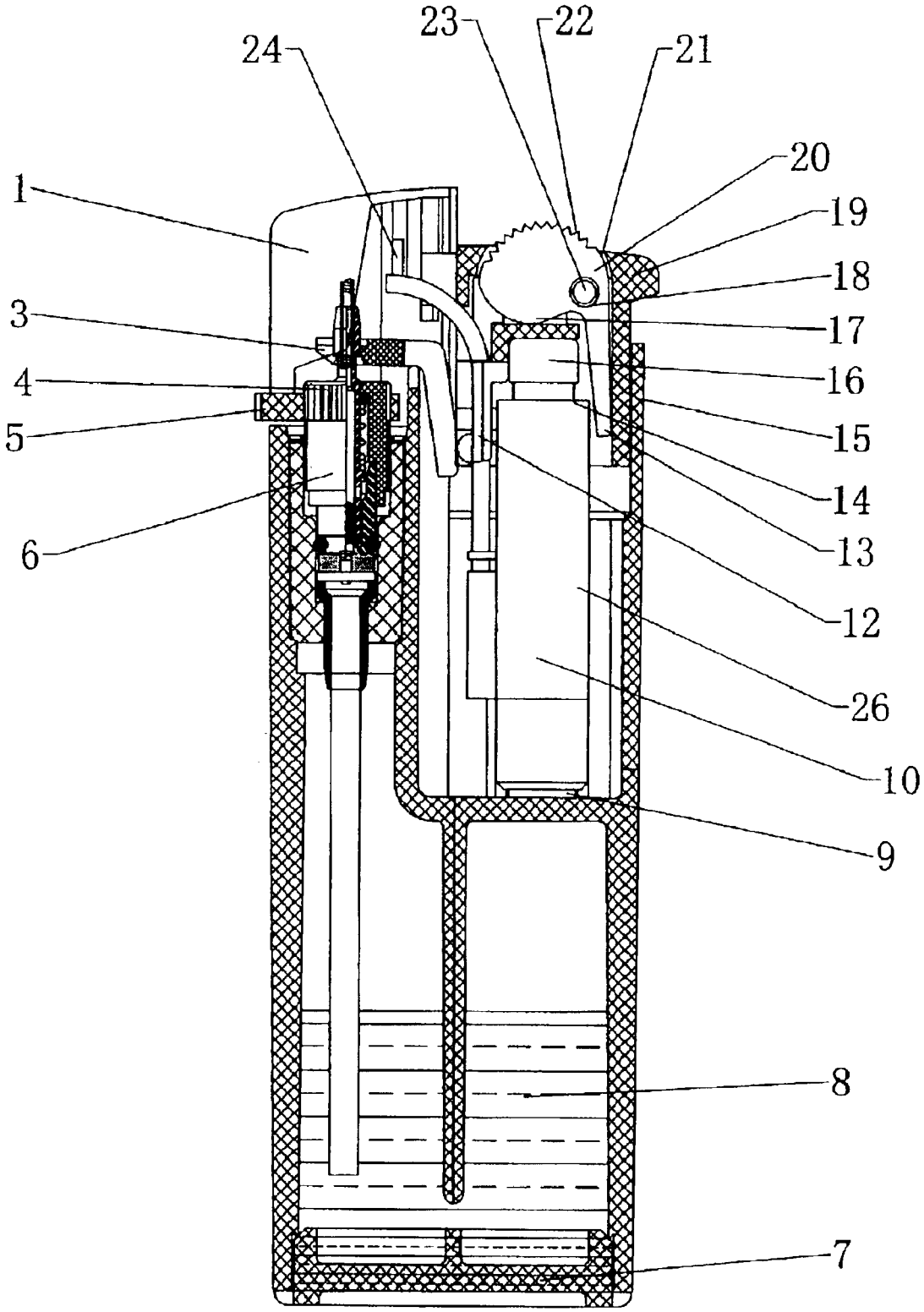
FIG. 1 is a schematic view showing a gas lighter according to an embodiment of the present invention.

As shown in FIG. 1, a gas lighter with a locking device according to the present invention comprises: a housing 15 for containing the combustible gas 8, a piezoelectric device 10 in the housing 15, an outlet device 6 and a windshield 1 thereabove for shielding the flame from the wind, and an inner shield 24 in the windshield 1 for isolating the flame, wherein the outlet device 6 comprises an outlet valve 4 and a lever 3. A regulator ring 5 is provided for the outlet valve 4 for regulating the amount of the gas. The piezoelectric device 10 comprises a piezoelectric rod 16, a top cap 12 above the piezoelectric rod 16, and an actuator 19. When the actuator 19 is pressed down, the lever 3 is correspondingly pressed down so as to open the outlet valve 4 and release the combustible gas. Then, the piezoelectric rod 16 results in a temporary strong current and sparks so as to generate a flame. A rubber cushion 9 is placed under the piezoelectric rod 16 for absorbing the shock. A bottom cover 7 is provided on the bottom of the housing 15 for sealing the combustible gas. The above-mentioned components are assembled together in a conventional manner. A case 26 is provided for the piezoelectric rod 16, which forms a step 14 for the piezoelectric rod 16. An ignition actuator 19 is provided above the piezoelectric rod 16, and a locking device for the actuator 19 is also above the piezoelectric rod 16. The locking device comprises a q-shaped locking lever 20. The upper end 22 of the q-shaped locking lever 20 is protruded out of the upper surface of the actuator 19, and is provided with anti-slipping wrinkles. The middle portion 17 of the q-shaped locking lever 20 abuts against the top cap 12 all the time. The lower portion 13 of the q-shaped locking lever is interposed between the side walls of the actuator 19 and the piezoelectric rod 16. The lower end 13 of the q-shaped locking lever normally abuts against the step 14 of the piezoelectric device so as to lock the lighter. The locking lever 20 is coupled within the inner chamber of the actuator 19 via a rotation shaft 23 provided on the actuator and can flexibly rotate about the rotation shaft 23. An opening 21 is provided in the actuator 19 for axially positioning the q-shaped locking lever 20. The edge of the opening 21 adjacent to the periphery of the q-shaped locking lever 20 is of an arc shape so as to make the q-shaped locking lever rotate flexibly.

The lower end 13 of the q-shaped locking lever 20 normally abuts against the step 14 of the piezoelectric device. In this case, whiling pressing the actuator, the lower end 13 of the q-shaped locking lever abuts against the step and thus the actuator can not be pressed down, so that the lighter is locked in its locking position.

Figure 2:
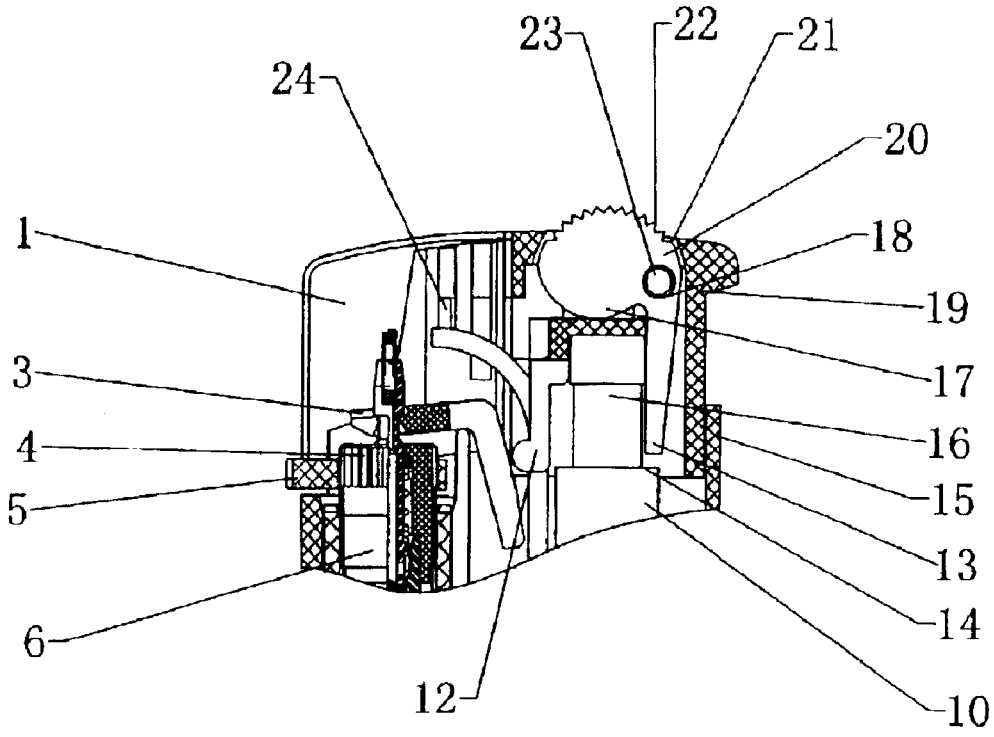
FIG. 2 is a schematic view showing the gas lighter of FIG. 1 with the locking device in its locking position.

As shown in FIG. 2, if an ignition is required, the q-shaped locking lever 20 should be rotated in an anti-clockwise direction by means of an external force F1 applied by a finger so that the middle portion 17 of the q-shaped locking lever 20 can move against the resilient force of the spring 27 in the piezoelectric device 10. Then, the lower end 13 of the q-shaped locking lever naturally disengages from the step 14 of the piezoelectric device so that the actuator 19 can be pressed down by means of an external force F2 applied by the same finger and the ignition operation can be completed.

After completing an ignition operation, the finger can be released and thus the external force is released so that the actuator can be restored to its locking position under the resilient force of the spring 27 in the piezoelectric device 10, which will be described in detail later. The q-shaped locking lever is correspondingly restored together with the actuator 19. Then, the middle portion 17 of the q-shaped locking lever abuts against the top cap 12 and the lower end 13 thereof abuts against the step 14 for the piezoelectric block again so that the lighter is restored to its locking position.

Specifically, FIG. 2 shows the gas lighter of FIG. 1 with the locking device in its locking position, wherein said lighter cannot generate a flame. The lower end portion 13 of the locking lever 20 touches with the step 14 of the piezoelectric device. Since the actuator 19 is prevented from being pressed down, the lever 3 can not open the outlet valve 4, and then the piezoelectric rod 16 can not spark so as not to ignite the gas.

Figure 3:
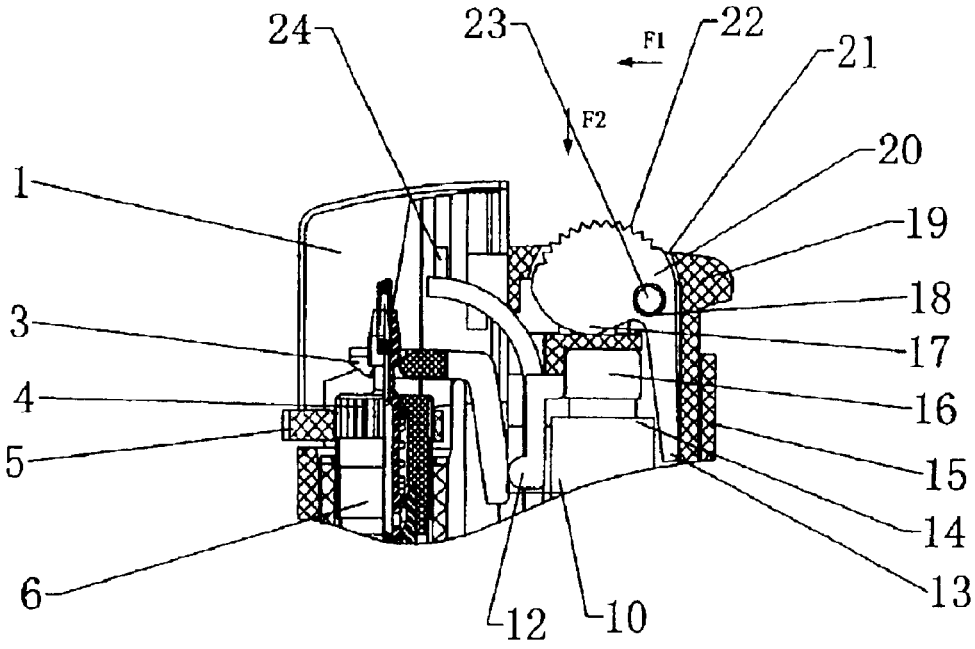
FIG. 3 is a schematic view showing the gas lighter of FIG. 1 with the locking device in its unlocking position.

FIG. 3 shows the gas lighter of FIG. 1 with the locking device in its unlocked position, wherein said lighter can generate a flame. As shown in FIG. 3, the thrust force F1 is applied at least horizontally by the user, and then the lower end portion 13 of the locking lever 20 is disengaged from the step 14 of the piezoelectric device. Therefore, the locking lever 20 moves from the locking position wherein said lighter cannot generate a flame to the unlocking position wherein said device can generate a flame. Then, the second force F2 is applied in the adjacent region by the thumb so as to press down the actuator 19 by changing the direction of the forces applied by the thumb without changing the position of the thumb. The lever 3 opens the outlet valve 4, and then the piezoelectric rod 16 sparks so as to ignite the gas.

The regulator ring 5 for adjusting the flame is provided on the outlet device 6. The windshield 1 is adapted to shield the flame from the wind, and the inner shield 24 is adapted to isolate the flame.

The locking device 20 is substantially of q-shape, which upper end 22 is of a semi-sphere shape and is positioned in the surface of the actuator 19, the side-middle end 17 thereof abuts against the top cap 12 above the piezoelectric rod 16, and the lower end 13 thereof engages with the step 14 of the piezoelectric device in the locking position and disengages from the step in the unlocking position.

After the ignition of the gas lighter with a locking device, the entire locking device can be restored to its locking position automatically by means of the spring force of the spring 27 in the piezoelectric device, but not by means of an external spring or an external force. According to the present application, the locking device can be restored to its locking position automatically under the action of the spring generally provided in the piezoelectric device without any external spring and external force. Therefore, the lighter of the present application can be used more conveniently and easily.

Figure 4:
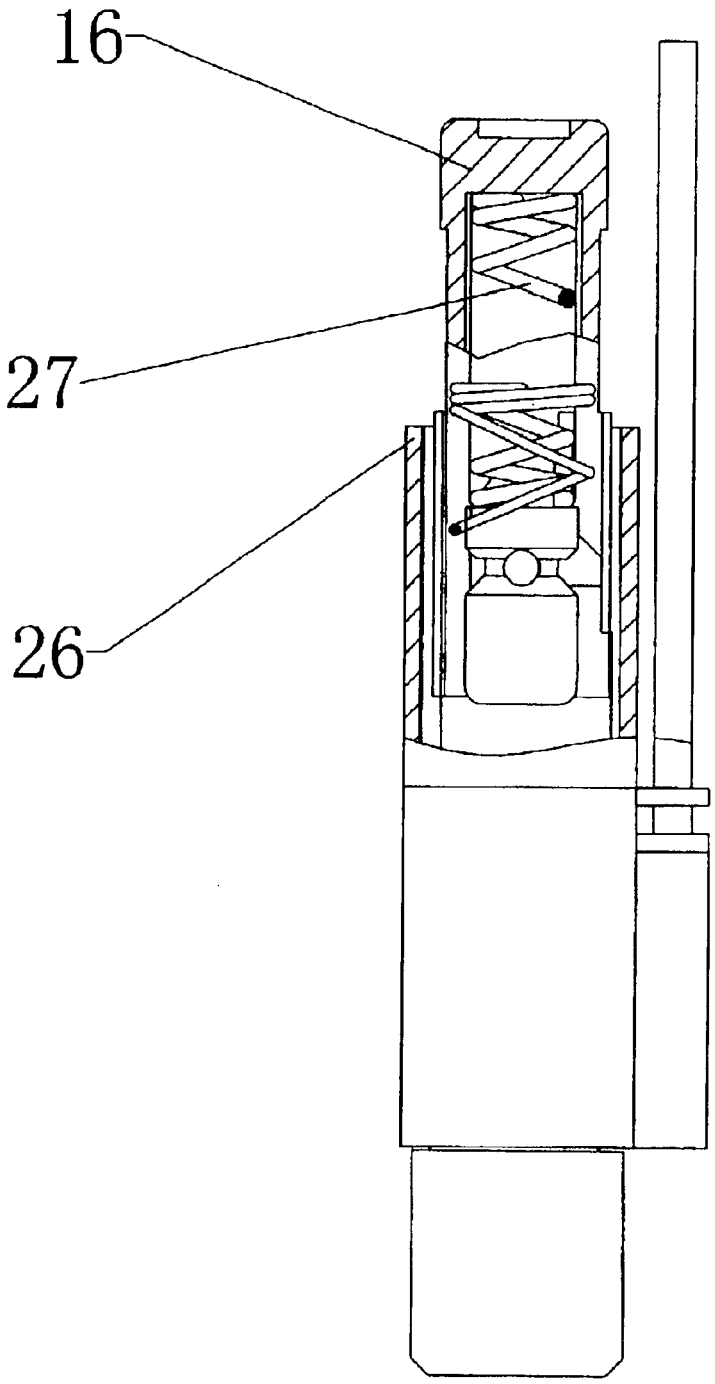
FIG. 4 shows a piezoelectric mechanism generally used in the prior lighter.

Specifically, as shown in FIG. 4, in which an existing piezoelectric device used in the prior art and in the present application is shown, after an ignition is completed, the finger is released and then the actuator 19 and the locking lever 20 move up together to the normal position of the actuator under the spring force of the spring 27 provided in the piezoelectric rod 16. Then, the actuator will not move any more. At this time, the locking lever 20 and the spring 27 have not completely moved to their normal position yet, i.e., their locking position. Then, the middle portion 17 of the locking lever rotates about the shaft 23 in the clockwise direction under the continual spring force of the spring 27. When the spring 27 is completely restored to its original position, the lower portion 13 of the locking lever 20 is also restored to its original position and abuts again against the step 14. Then, the locking device is restored to its locking position.

In the embodiment described above, the middle portion 17 of the locking lever 20 directly abuts against the top cap 12. However, a recess can be provided through the top cap 12 and the middle portion 17 of the locking lever 20 may contact with the top surface of the piezoelectric rod 16 through the recess and thus the middle portion 17 together with the whole locking lever 20 can move freely.

In addition, the shaft 23 about which the locking lever 20 rotates is not aligned with the contact point between the middle portion 17 of the locking lever 20 and the top cap 12 in the vertical direction.

As used herein, the ignition means includes any suitable ignition device, such as a piezoelectric ignition mechanism or the like, a suitable housing for storing fuel for the lighter, such as gas fuel for a gas lighter, and a suitable valve mechanism for controlling the release of the fuel from the housing.

What is claimed is:

1. A lighter with a locking device, comprising:

a housing with a fuel chamber for containing a fuel;

a fuel outlet device coupled to the fuel chamber for selectively releasing fuel from the fuel chamber;

a piezoelectric device in the housing and having a plunger in a casing with a shoulder and a resilient member for providing a returning force when the piezoelectric device is actuated;

an actuator coupled to the piezoelectric device for actuating the lighter;

a locking device in a top surface of the actuator for permitting or preventing actuation of the lighter, the locking device having a pivot point about which the locking device is pivotable;

a cam portion on the locking device for transferring an urging force applied to the cam portion to the locking device; and a leg extension on the locking device operable to engage the shoulder of the casing in a locking position to thereby prevent actuation of the lighter.

2. A lighter with a locking device according to claim 1, wherein the locking device can be restored to its locking position automatically by a spring.

3. The lighting device according claim 1, wherein the locking device has a q-shape.

4. A lighter with a locking device according to claim 3, wherein the locking device can be restored to its locking position automatically by a spring.

5. The lighter according to claim 1, further comprising a plurality of protrusions on an upper portion of the locking device.

6. A lighter with a locking device according to claim 5, wherein the locking device can be restored to its locking position automatically by a spring.

7. The lighter according to claim 1, wherein the locking device protrudes above an upper surface of the actuator.

8. The lighter according to claim 7, further comprising an opening in the actuator, through which the locking device protrudes.

9. The lighter according to claim 1, wherein the locking device is coupled to the piezoelectric device to urge the locking device into a locking position.

10. The lighter according to claim 1, wherein the resilient member urges the plunger against the cam portion to urge the locking device towards the locking position.

11. A locking device for a lighter, comprising:

an actuator having an opening therethrough for receiving a locking arm actuation portion;

a locking arm pivotably coupled with the actuator, the locking arm having a cam portion and a leg extension for interacting with a piezoelectric element plunger and casing to permit or prevent actuation of the actuator;

the actuation portion of the locking arm extending through the opening of the actuator, the cam portion of the locking arm being coupled to the plunger of the piezoelectric element, the cam portion receiving an urging force from the plunger to urge the looking arm to a locking position;

the leg extension positioned to abut the casing of the piezoelectric element in the locking position to prevent actuation of the actuator.

12. The locking device according to claim 11, wherein the actuation portion of the locking arm extends above a surface of the actuator.

13. A method for locking a lighter actuator, comprising:

providing a locking device in a pivotably fixed relationship in the actuator at a location in proximity to a lighter piezoelectric element;

urging the locking device to pivot towards a locking position through a resilient force supplied by the piezoelectric element;

causing an extension of the locking device to abut a portion of the piezoelectric element in the locking position to prevent actuation of the actuator.

14. The method according to claim 13, further comprising pivoting the locking device to prevent the extension from abutting the plunger to permit actuation of the actuator.

15. The method according to claim 13, further comprising restoring the locking device to a locking position through the urging of the resilient force supplied by the piezoelectric element.

16. The method according to claim 13, further comprising coupling the locking device to the piezoelectric element through a cam on the locking device.

* * * * *